US005172029A

United States Patent [19]

Norris et al.

[11] Patent Number: 5,172,029

[45] Date of Patent: Dec. 15, 1992

[54] SHIELDED HELIX TRAVELING WAVE CATHODE RAY TUBE DEFLECTION STRUCTURE

[75] Inventors: Neil J. Norris; Charles L. Hudson, both of Santa Barbara, Calif.

[73] Assignee: The United States of America as represented by the United States Department of Energy, Washington, D.C.

[21] Appl. No.: 643,304

[22] Filed: Jan. 22, 1991

[51] Int. Cl.[5] ..... H01J 23/10

[52] U.S. Cl. ..... 315/003; 315/5.24; 313/421

[58] Field of Search ..... 315/3, 5.24, 7, 8, 399; 313/421, 431

[56] References Cited

U.S. PATENT DOCUMENTS

| | | | |
|---|---|---|---|
| Re. 28,223 | 11/1974 | Odenthal et al. | 315/3 |
| 2,843,791 | 7/1958 | Pierce | 315/39.3 X |
| 3,153,742 | 10/1964 | Kluver | 315/3 |
| 3,376,464 | 4/1968 | Loty et al. | 315/3 |
| 3,504,222 | 3/1970 | Fukushima | 315/3 |
| 3,694,689 | 9/1972 | Odenthal et al. | 315/3 |
| 3,696,266 | 10/1972 | Nishino et al. | 315/3 |
| 3,749,961 | 7/1973 | Bates et al. | 315/3 |
| 3,849,695 | 11/1974 | Piazza et al. | 315/3 |
| 3,916,255 | 10/1975 | Crandall | 315/5.24 |
| 4,093,891 | 6/1978 | Christie et al. | 315/3 |
| 4,207,492 | 6/1980 | Tomison et al. | 315/3 |
| 4,429,254 | 1/1984 | Chang | 315/3 |
| 4,465,988 | 8/1984 | Moats | 333/156 |
| 4,812,707 | 3/1989 | Correll | 313/435 |
| 4,894,628 | 1/1990 | Dadswell | 333/162 |

FOREIGN PATENT DOCUMENTS

| | | | |
|---|---|---|---|
| 788223 | 12/1980 | U.S.S.R. | 313/421 |

*Primary Examiner*—Eugene R. LaRoche
*Assistant Examiner*—Benny T. Lee
*Attorney, Agent, or Firm*—Roger S. Gaither; Miguel A. Valdes; William R. Moser

[57] ABSTRACT

Various embodiments of a helical coil deflection structure of a CRT are described and illustrated which provide shielding between adjacent turns of the coil on either three or four sides of each turn in the coil. Threaded members formed with either male or female threads and having the same pitch as the deflection coil are utilized for shielding the deflection coil with each turn of the helical coil placed between adjacent threads which act to shield each coil turn from adjacent turns and to confine the field generated by the coil to prevent or inhibit cross-coupling between adjacent turns of the coil to thereby prevent generation of fast fields which might otherwise deflect the beam out of time synchronization with the electron beam pulse.

18 Claims, 5 Drawing Sheets

SHIELDED HELIX TRAVELING WAVE CATHODE RAY TUBE DEFLECTION STRUCTURE

The invention described herein arose in the course of, or under, Contract No. DE-AC08-83NV10282 between the U.S. Department of Energy and EG&G Energy Measurements, Incorporated.

BACKGROUND OF THE INVENTION

This invention relates to deflection structures for cathode ray tubes. More particularly, this invention relates to a shielded helix traveling wave deflection structure for a cathode ray tube.

Helically shaped coils have been used as slow wave deflection structures in cathode ray tubes (CRTs)for many years. They deflect the electrons in a CRT beam by creating a deflecting field that travels at the same velocity as the electrons in the beam, thereby gaining a high sensitivity and good bandwidth. Several different types and modifications of such structures have been described in the patent literature. For example, Kluver U.S. Pat. No. 3,153,742 describes an electron tube delay device wherein an electron beam travels down a helical drift path; an input cavity resonator which transfers signal wave energy to the beam; and an output cavity resonator which extracts signal wave energy from the beam. The beam is directed down the helical path by a trough-shaped negative electrode that produces an electric focusing field with a surrounding cylindrical electrode.

Correll U.S. Pat. No. 4,812,707 discloses an electron beam deflection structure of the traveling wave type comprising a first helical coil and a second helical coil interleaved with one another and coaxial with the axis of the tube. The first coil has wide segments positioned on the bottom with narrow segments on the top while the second coil has wide segments on the bottom and narrow on the top. Differential voltage signals of opposite polarity are applied to the first and second coils.

Nishino et al. U.S. Pat. No. 3,696,266 shows an electron beam deflecting device with a helical electrode coaxially surrounded by a cylindrical outer electrode. By tapering the helical strip structure forwardly on its side defining the passage of the electron beam, the center line of the beam is deviated for an angle one-half that of the taper.

Odenthal et al. U.S. Pat. No. 3,694,689 and Reissue U.S. Pat. No. 28,223 describe a helical delay line deflection apparatus to reduce the deflection signal in the axial direction along the helical deflector until it is equal to the electron beam velocity to permit very high frequency signals to deflect the beam without appreciable distortion. A pair of helical deflector members having rectangular turns are provided, each having a pair of flat side portions separated by a deflector portion of different width. Two pairs of grounded adjustable compensator plates are positioned adjacent the flat side portions on opposite sides of both helical members to form delay lines. The width and spacing of adjacent deflection portions is substantially uniform while the width and spacing of adjacent side portions varies for successive turns of the path along the electron beam to provide good response deflection sensitivity with an extremely wide band width frequency response.

Crandall U.S. Pat. No. 3,916,255 shows a phase array amplifier for generating multiple channels of high frequency electromotive power. Each channel contains an electron beam gun, to generate an electron beam and deflection plates along the beam path to modulate the beam. In one embodiment, the deflector plates comprise a helical electrode and a control grounded electrode.

Loty et al. U.S. Pat. No. 3,376,464 discloses a cathode ray apparatus which includes a flat helical deflection electrode and a second electrode having a part within the helical electrode disposed along its axis and an outer part practically completely surrounding the helical electrode.

Christie et al. U.S. Pat. No. 4,093,891 describes an electron beam deflection apparatus comprising a pair of diverging flat helically wound coils disposed on opposite sides of the beam axis.

Tomison et al. U.S. Pat. No. 4,207,492 describes an electron beam deflection structure comprising serpentine deflection plate segments which are interconnected together by elongated loops.

Piazza et al. U.S. Pat. No. 3,849,695 shows a deflection structure for a cathode ray tube which comprises a helical electrode bonded to the teeth of a comb-like dielectric support structure. The electron beam passes between the helical electrode and a ground plane. In one embodiment, two such helical electrodes oppose one another and two opposing ground plane electrodes are situated adjacent the helical electrodes with the beam passing down the middle between the opposing helical electrodes and ground plane electrodes.

Chang U.S. Pat. No. 4,429,254 discloses an electron beam deflection yoke comprising four rod-shaped members running parallel to the axis of the beam and disposed around the beam axis, each having a wire coil wound along the rod to form horizontal and vertical deflection coils.

However, in most of these devices a serious problem exists which causes a "precursor" artifact to appear on the CRT trace in advance of the rise time when a fast rising pulse is measured by the CRT. This spurious signal is caused by fields which are not confined to the helical transmission line or deflection coil, but are coupled between turns of the helical coil or coils, or are transmitted by higher velocity modes in the space between the helix and the ground planes. These fast fields deflect the electron beam at an earlier time than the correct time in the pulse and cause an erroneous signal to appear where there should be none. This artifact or spurious signal is more serious and detrimental in high bandwidth CRTs, i.e., CRTs having a bandwidth of about 2 GHz (2000 MHz) and above, because the high frequency components of these signals are preferentially coupled along the structure.

It would, therefore, be desirable to provide a helical coil type deflection structure for a cathode ray tube device which would eliminate the propagation of such fast signals along the helical deflection structure.

SUMMARY OF THE INVENTION

It is, therefore, an object of this invention to provide an improved helical coil deflection structure for a cathode ray tube wherein each turn in the coil is separated from adjacent turns by conductive shielding means which surrounds at least three sides of each turn of the helical coil.

It is another object of this invention to provide an improved helical coil deflection structure for a cathode ray tube wherein each turn in the coil is separated from adjacent turns by shielding means which comprises a threaded conductive member in which two adjacent thread sidewalls and the root of the thread together surround three sides of each turn.

It is yet another object of this invention to provide an improved helical coil deflection structure for a cathode ray tube wherein each turn in the coil is separated from adjacent turns by shielding means which comprises a threaded conductive member having either male or female threads of the same pitch as the pitch of the deflection coil in which two adjacent thread sidewalls and the root of the thread together surround three sides of each turn.

It is still another object of this invention to provide an improved helical coil deflection structure for a cathode ray tube wherein each turn in the coil is separated from adjacent turns by shielding means which comprises a threaded conductive member having either male or female threads of the same pitch as the pitch of the deflection coil in which two adjacent thread sidewalls and the root of the thread together surround three sides of each turn and the fourth side is also shielded by a sleeve or core which respectively contact the male or female threads on the threaded member.

It is a further object of this invention to provide an improved helical coil deflection structure for a cathode ray tube wherein each turn in the coil is separated from adjacent turns by shielding means which comprises a threaded conductive member having either male or female threads of the same pitch as the pitch of the deflection coil in which two adjacent thread sidewalls and the root of the thread together surround three sides of each turn and two of such deflection structures are aligned together to deflect the beam along one plane.

It is still a further object of this invention to provide an improved helical coil deflection structure for a cathode ray tube wherein each turn in the coil is separated from adjacent turns by shielding means which comprises a threaded conductive member having either male or female threads of the same pitch as the pitch of the deflection coil in which two adjacent thread sidewalls and the root of the thread together surround three sides of each turn and four of such deflection structures are aligned together to deflect the beam along both the x and y planes.

These and other objects of the invention will be apparent from the following description and accompanying drawings.

DETAILED DESCRIPTION OF THE INVENTION

The invention provides a helical deflection coil structure, which functions as a signal transmission line of desired properties, for use with an electron beam in a cathode ray tube, wherein adjacent turns of a conductor shaped as a helical coil are shielded from one another. The shielding is provided by a helical thread of the same pitch cut into a conductive member wherein the distance between adjacent crowns of the helical thread is greater than the width of the conductor used to form the helical coil, and the distance from the root to the crown of the helical thread is greater than the height of the conductor used to form the helical coil. The conductive member is grounded so that the helical coil is surrounded on at least three sides by grounded shielding.

The use of the term "thread" herein is intended to depict the thread-like form that a spiral trough may take, rather than refer to the fastening or sealing connotations of a "thread".

Figure 1:
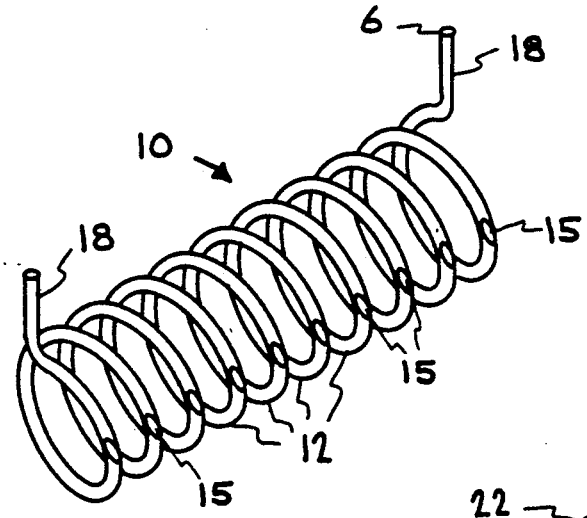
FIG. 1 is an isometric view of the helical deflection coil used in the helical deflection coil structure of the invention formed using a conductive material of circular cross-section.
Figure 2:
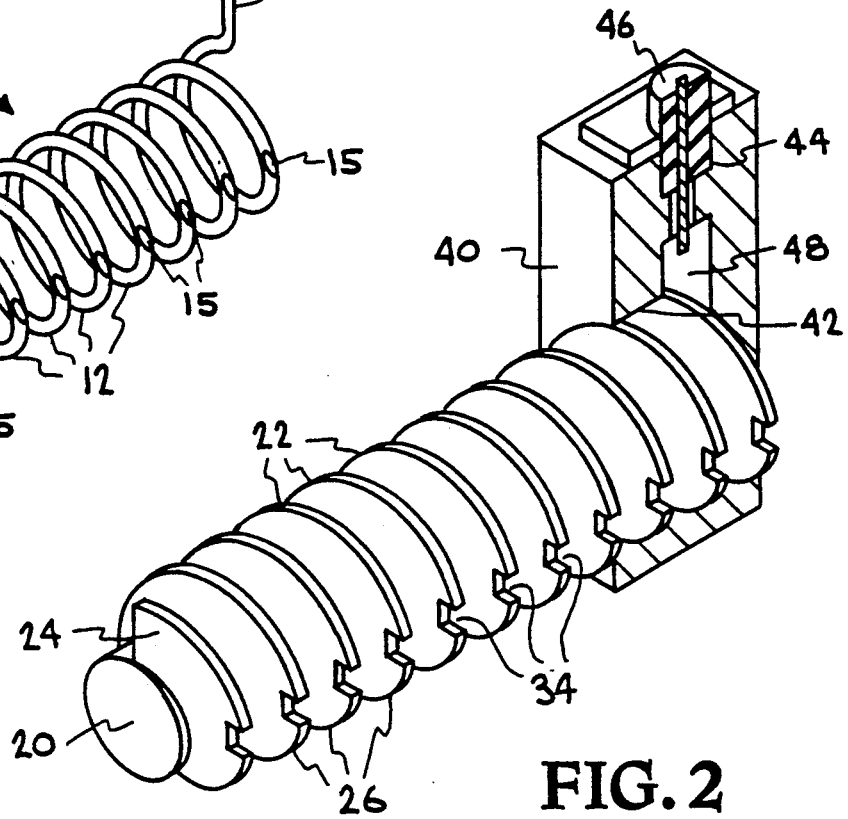
FIG. 2 is an isometric view of a threaded member having helically shaped male threads thereon to provide shielding for the helical deflection coil.
Figure 3:
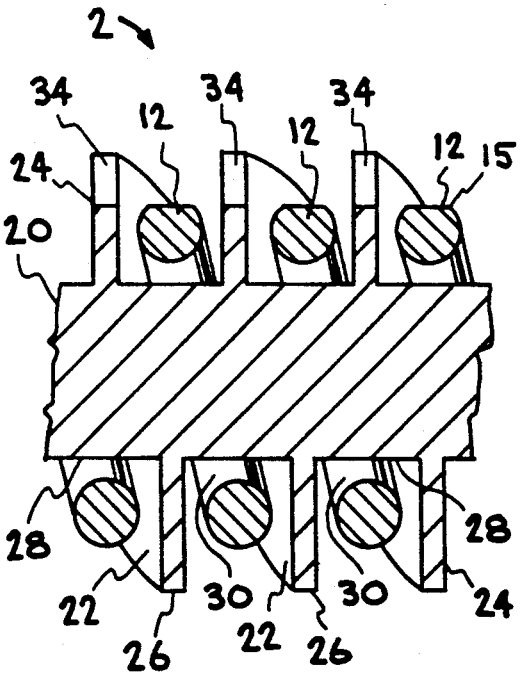
FIG. 3 is a cross-sectional view showing the mating of the helical coil of FIG. 1 with the helically threaded member shown in FIG. 2.

Turning now to FIGS. 1–3, one embodiment of the helical coil deflection structure 2 (see FIG. 3) of the invention is illustrated, wherein a conductor 6, of circular cross-section, is helically wound into a conductive coil 10, having a plurality of equally spaced apart turns 12 (see FIG. 1).

Helical coil 10 is positioned around a threaded conductive member 20 (see FIG. 2), which may comprise, for example, a threaded metal rod, having a male thread of the same pitch (i.e., turns per centimeter) as coil 10. The male thread on threaded member 20 comprises a continuous helical thread which, when viewed in cross-section as in FIG. 3, comprises a series of threads 22 having sidewalls 24, a crown 26 on each thread 22, and a root 28 between adjacent threads 22, so as to define a series of troughs 30 (see FIG. 1). Each thread 22 of threaded member 20 is shown positioned between adjacent turns 12 of coil 10, as best seen in FIG. 3, i.e. each turn 12 of coil 10 is positioned within a trough 30 defined by the threads 22 and roots 28 of threaded member 20.

The distance from the crown 26 to the root 28 of the threads is greater than the diameter of circular conductor 6, while the outer diameter (O.D.) of coil 10 is less than the diameter of the crowns 26 of threaded member 20, so that each turn 12 of coil 10 is surrounded on three sides by the root 28 and the respective sidewalls 24 of adjacent threads 22. By grounding conductive threaded member 20, coupling between adjacent turns of coil 10 can be mitigated, if not completely eliminated by this shielding of coil turns 12 of coil 10 by the threads 22 of conductive threaded member 20.

It will be particularly noted in FIG. 3 that coil 10 is mounted in troughs 30 so that coil 10 does not make contact with any surfaces of threaded member 20 since this would short out coil 10. This spacing of coil 10 from the surfaces of threaded member 20 may be maintained by providing insulated spacers, e.g., glass beads or the like, around and in contact with coil 10 at various points along the helical path in threaded member 20 defined by troughs 30.

However, the provision of such insulative spacers also provides an undesired capacitive coupling between coil 10 and the grounded shield of threaded member 20. Therefore, preferably no such spacers are used. Rather helical coil 10 is accurately formed and positioned in troughs 30 of threaded member 20 so that no solid supporting or locating elements are required between coil 10 and threaded member 20 and therefore, no dielectric materials with a dielectric constant greater than one (1.0) is present. This could be accomplished, for example, either by preforming coil 10 to rather exact dimensions followed by threading it into threaded member 20 or by using a disposable spacer, such as a low melting temperature wax or an organic material which is placed in the troughs 30 of threaded member 20 to partially fill the troughs followed by formation of coil 10 over such disposable materials and then subsequent removal of such materials prior to installation of deflection structure 2 of the invention in a CRT. By removing such materials and by not using solid spacers between the coil and the threaded member, a possible source of outgassing upon subsequent exposure of the structure to high temperatures and high vacuum is eliminated.

Thus, the helical coil may be defined as being located in the space in the threaded member between the threads (laterally) and between the roots and the crowns of the threads (vertically) without the use of means which would emit disruptive molecules when exposed to high temperature and high vacuum, such as during bake-out of the CRT, and without the use of means which would contribute additional capacitive coupling between the coil and the grounded shield comprising the threaded member. The terms "disruptive molecules", "high temperature" and "high vacuum" above refer to the undesirable gases or vapors which may be emitted if a material is used in the CRT with a vapor pressure higher than the "high vacuum" of $10^{-7}$ Torr or lower pressure in the CRT during the bakeout of the CRT at a "high temperature" of 200° C. or higher.

As shown in FIG. 2, each end of helical coil 10 and threaded member 20 may be fitted into a circular bore 42 of an end block member 40, both for mechanical support of the coil/assembly as well as to provide a means for housing, in a bore 44, a standard high temperature feed through vacuum-tight electrical connector 46, such as commercially available from Kaman Instrumentation Corp., Colorado Springs, Colo.; Hermetic Seal Corp., Rosemead, Calif.; and Woburn CRT operation of EG&G/EM, Woburn, Mass. Connector 46 makes electrical contact with one end 18 (see FIG. 1) of coil 10 which is received in a cutaway portion 48 in end block 40. While only one such end block member is shown in FIG. 2, it will be appreciated that such an end block member is provided at each end of coil 10 so that both mechanical support and electrical connection may be effected at both ends of coil 10.

End block member 40 may be constructed of an electrically conductive material, e.g., a metal, and it should also be at the same ground potential as threaded member 20.

As further shown in FIG. 2, a notch 34 may be cut or formed in each crown 26 of threads 22 in longitudinal alignment with one another and to a depth of less than the distance from the crown of each thread to the O.D. of each turn 12 of coil 10. The passageway thus formed along threads 22 will therefore extend longitudinally down threaded member 20 along an axis parallel to the axis of threaded member 20 to define a passageway for the electron beam of the CRT device into which the deflection structure of the invention will be mounted. Each turn 12 of helical deflection coil 10 is flattened, as shown at 15 in FIGS. 1, 3, and 5, for a tranverse distance extending at least the width of the beam passageway in order to provide a uniform and proper electromagnetic field.

As the electron beam thus travels through deflection structure 2, through notches 34, it is appropriately and properly deflected by each turn 12 of helical coil 10, with the deflection signal traveling along helical coil 10 in time synchronization with the speed of the electron beam. By this means, spurious deflection signals that are out of time synchronization with the electron beam are not generated by coupling between adjacent turns 12 of coil 10.

Figure 4:
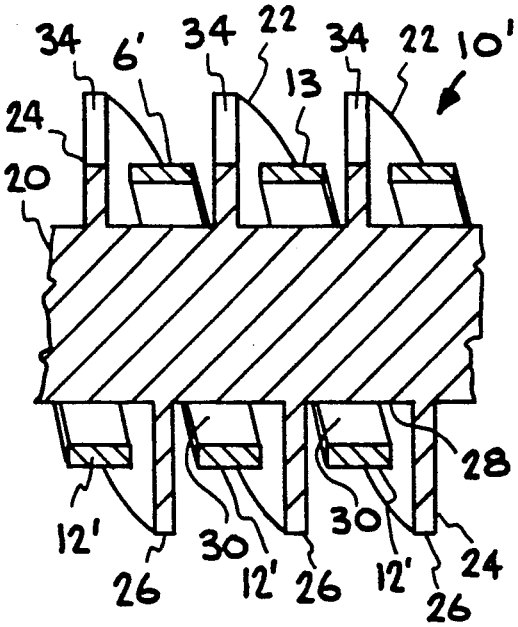
FIG. 4 is a cross-sectional view of a modification of the embodiment shown in FIGS. 1–3 using a helically shaped deflection coil formed from rectangularly cross-sectioned conductive material rather than a circular core conductive material.

As shown in FIG. 4, in a modification of the embodiment illustrated in FIGS. 1-3, circular conductor 6 which is coiled to form coil 10, may be replaced by a conductor 6' of rectangular cross section to form a coil 10' wherein the flat surfaces are generally coaxial to the axis of coil 10'. As in the previous embodiment, both coil 10' and threaded member 20 must have the same pitch and the width of the flat portion 13 of each turn 12' must be less than the width between sidewalls 24 of adjacent threads 22 at that point and flat portion 13 of each turn 12' must be located above root 28 and below crown 26 to permit the desired shielding of coil 10' as in the first embodiment.

Figure 5:
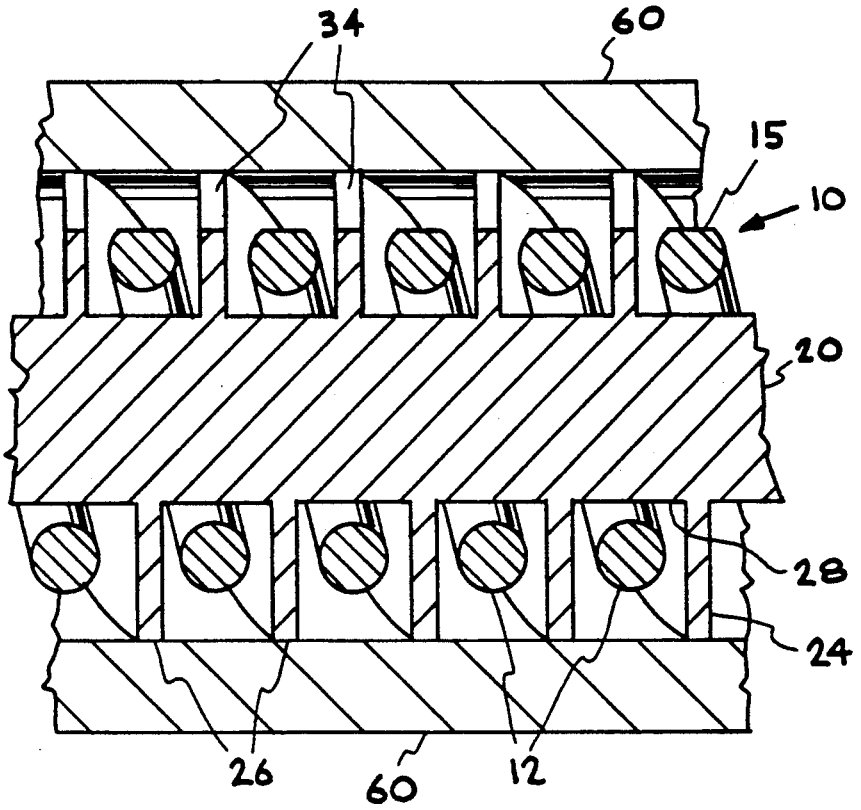
FIG. 5 is a cross-sectional view of another modification of the embodiment of FIGS. 1–3 wherein a conductive sleeve is fitted around the threaded member to afford additional shielding to the helical deflection coil.
Figure 6:
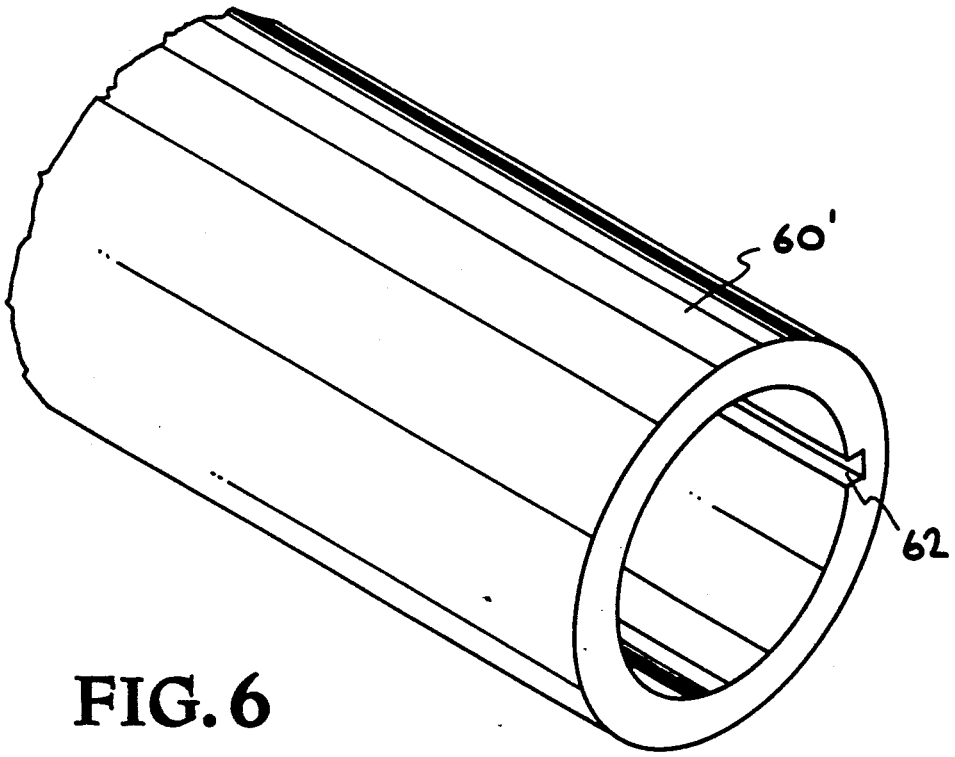
FIG. 6 is a fragmentary isometric view of the conductive sleeve of FIG. 5 modified to include an inner longitudinal slot for passage of the electron beam.

FIGS. 5 and 6, illustrate a second modification of the embodiment shown in FIGS. 1-3, wherein a conductive tube or sleeve 60 (see FIG. 5) may be placed around coil 10 and threaded member 20 with the I.D. of sleeve 60 just slightly larger than the O.D. of the crowns 26 of threaded member 20 to permit sleeve 60 to be slipped over threaded member 20 and coil 10 mounted therein. The addition of sleeve 60, which is also grounded, to deflection structure 2 provided shielding around all four sides of each turn 12 of coil 10.

In this embodiment, notch 34 may again be provided in each crown 26 of threads 22 of threaded member 20 as previously described to provide a path for the electron beam. However, in this embodiment, it is possible, if desired to replace the notches 34 with a longitudinal slot 62 formed along the inner wall of sleeve 60', as shown in FIG. 6, i.e., parallel to the axis of sleeve 60', coil 10 and threaded member 20, so that the electron beam travels along slot 62 in sleeve 60'.

In this second modification of the first embodiment, sleeve 60'may extend along the entire length of coil 10 and threaded member 20, in which case bore 42 (see FIG. 2) in end block member 40 will be enlarged to accommodate sleeve 60' and an opening will be provided adjacent each end of sleeve 60' in alignment with the respective opening in end block 40 to permit electrical connection between each end 18 of coil 10 and electrical connector 46. The modification described above is not shown in any drawing.

Alternatively, sleeve 60 may be foreshortened so that it terminates at end block 40 at each end. In such a case, if sleeve 60 is provided with the previously described longitudinal slot 62 as an electron beam path, i.e., sleeve 60' shown in FIG. 6, a corresponding slot may be formed in the sidewall of bore 42 in end block member 40 to permit passage of the electron beam therethrough.

It should be noted that either sleeve 60 or sleeve 60', in the various forms just discussed, may be utilized in combination with the previously described flat coil 10' of FIG. 4 as well as coil 10 made from circular conductor 6 as described in the first embodiment.

Figure 7:
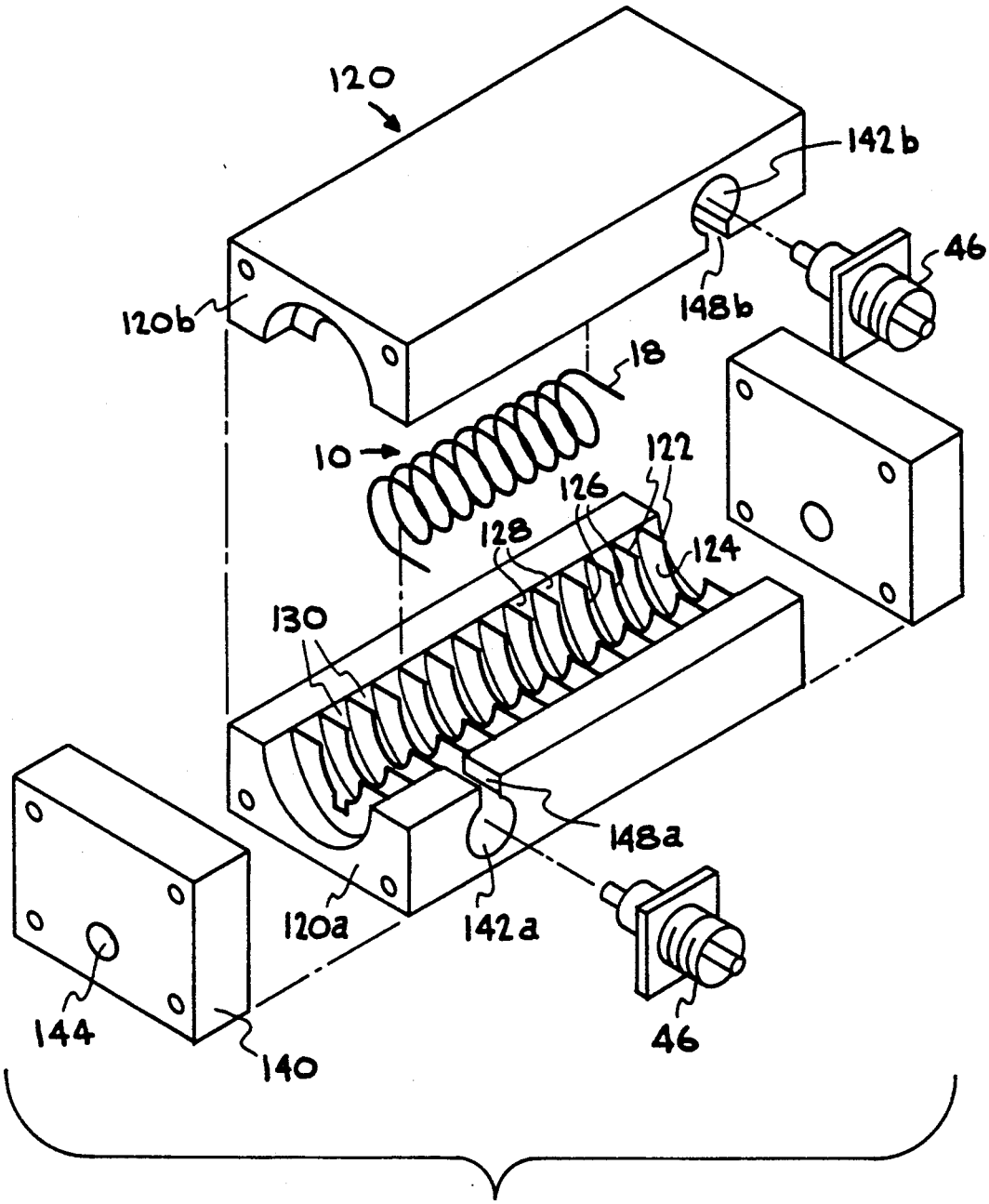
FIG. 7 is an exploded view of another embodiment of the invention wherein a female helical thread is used in the shielding of a helical deflection coil.
Figure 8:
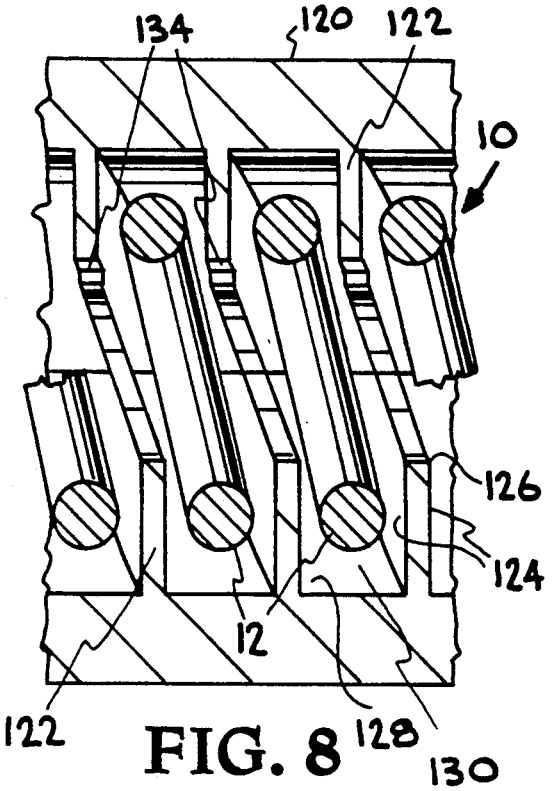
FIG. 8 is a cross-sectional view of the embodiment of FIG. 7 illustrating the shielding of the deflection coil by the female threads.

FIGS. 7 and 8 show another embodiment of the invention wherein the male helical thread on threaded member 20 is replaced by a female helical thread in a threaded conductive member 120 which, as illustrated in the exploded view of FIG. 7, may conveniently made in two parts or halves **120*a* and 120*b*. As in the first embodiment, coil 10 has the same pitch (number of turns per centimeter) as the helical thread so that each thread 122 will act as a separator or shield between adjacent turns 12 (see FIG. 8) of coil 10**.

The helical female thread in threaded member 120 is formed similarly to the helical male thread in threaded member 20, i.e., helical female thread comprises a series of threads 122 (see FIG. 7) having sidewalls 124, a crown 126 on each thread 122, and a root 128 between adjacent threads 122, so as to define a series of troughs 130. Each thread 122 of threaded member 120 is shown positioned between adjacent turns 12 of coil 10, as best seen in FIG. 8, i.e. each turn 12 of coil 10 is positioned within a trough 130 defined by threads 122 and roots 128 of threaded member 120 to thereby provide shielding for each turn 12 of coil 10 from adjacent turns 12.

End block support members 140, in this embodiment, may be used to secure both halves **120*a* and 120*b* together as a single unit. It is also necessary to provide electrical contact to ends 18 of coil 10 via electrical connectors 46. To carry this out, a bore 142*a* is provided in threaded half member 120*a* and an identical bore 142*b* is provided in threaded half member 120*b* to receive electrical connectors 46. Slots 148*a* and 148*b* are provided in the respective threaded halves 120*a* and 120*b* to permit coil ends 18 to be fitted into bores 148*a* and 148*b* to engage electrical connectors 46**.

A slot or notch 134 is formed or cut into crowns 126 of threads 122, as shown in FIG. 8, to form a longitudinal electron beam passage parallel to the axis of coil 10 and threaded member 120 to provide the desired deflection of the beam by coil 10. Aligned openings 144 (see FIG. 7) are then provided in end blocks 140 to permit passage of the electron beam therethrough.

While the embodiment of FIGS. 7 and 8 has been illustrated using coil 10, which utilizes circular core conductor 6, it will be appreciated that rectangularly sectioned core coil 10', shown in FIG. 4, may be used in connection with threaded member 120 as well in substitution for coil 10.

Figure 9:
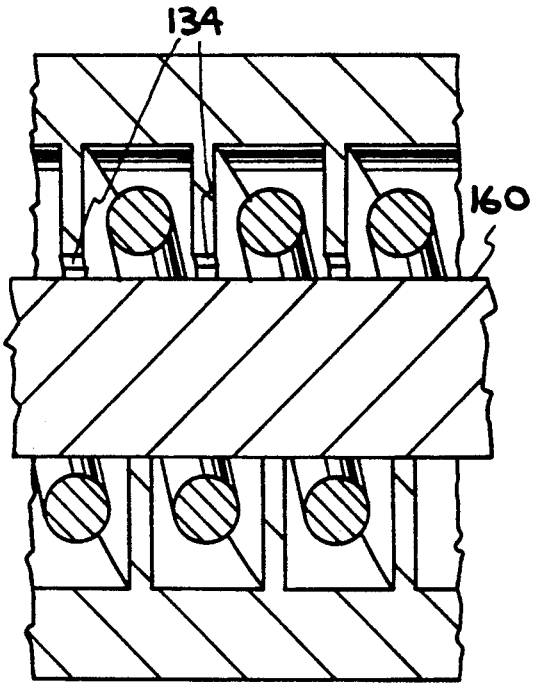
FIG. 9 is a cross-sectional view of a modification of the embodiment of FIGS. 7 and 8 wherein a central conductive core is shown as providing additional shielding for the helical deflection coil.

Referring to FIG. 9, a modification of the embodiment of FIGS. 7 and 8 is shown, which is similar to the FIG. 5 modification of the first embodiment. In this case, a conductive core member 160, which may comprise a solid rod or a hollow tube, having an O.D. just slightly smaller than the inside diameter (I.D.) of crowns 126 of the female helical coil in threaded member 120 may be inserted into threaded member 120, as shown in FIG. 9, to provide additional shielding for coils 10 or 10'. In this case, core member 160 would not have two optional lengths, as in the previous embodiment of FIGS. 5 and 6, but rather would extend the entire length of threaded member 120. End block support members 140 would then be also secured to the respective end surfaces of core member 160, as well as threaded member halves **120*a* and 120*b*** to secure the members together as a unit.

Figure 10:
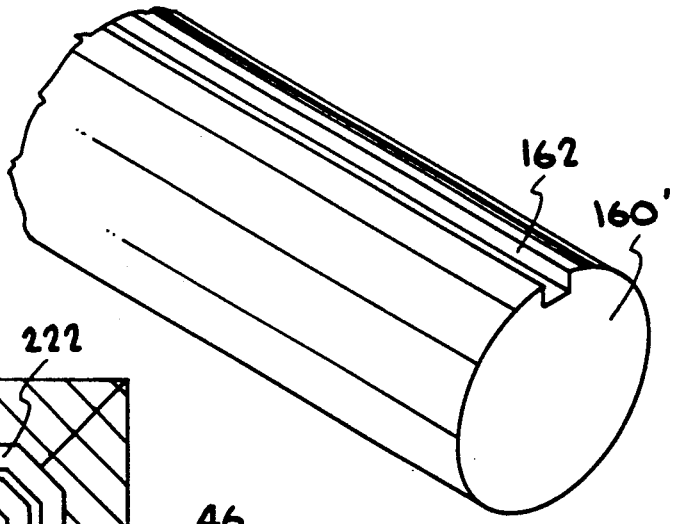
FIG. 10 is a fragmentary isometric view of the central core of FIG. 9 modified to provide a slot or groove for the passage of the electron beam therethrough.

When core member 160' shown in FIG. 10 is utilized, notches 134 in crowns 126 of the helical female thread may be replaced by a longitudinally extending slot 162 on the surface of core member 160' running parallel to the axis of core member 160' to provide an electron beam passageway. When slot 162 is utilized as the beam passageway instead of slots or notches 134, openings 144 in end block members 140 will be appropriately realigned to match the position of slot 162 so that the electron beam may pass therethrough.

Figure 11:
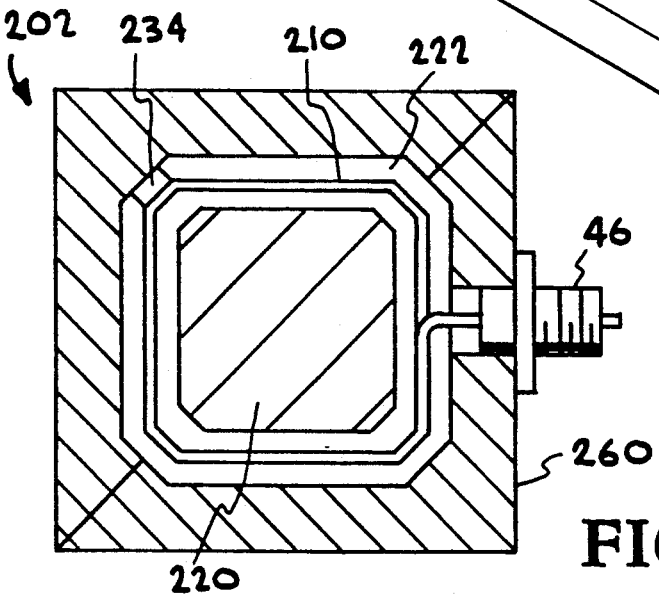
FIG. 11 is a cross-section end view of yet another embodiment of the invention wherein the helical deflection coil and the threaded member are both generally rectangular instead of circular in cross-section.

Turning now to FIG. 11, yet another embodiment is illustrated wherein a rectangular deflection structure 202 is shown comprising a helical coil 210 having a rectangular cross-section, instead of circular, with a threaded conductive block 220 which is also rectangular in cross-section. In the embodiment shown in FIG. 11, the threads are male threads 222 formed in block 220 with a notch 234 formed or cut into the corner of each thread to form an electron beam passageway in similar fashion to the embodiments just described. As in the previously described embodiments, the threads are dimensioned to provide shielding around three sides of each turn of coil 210. In the illustrated embodiment, helical coil 210 is surrounded by a tight fitting conductive shell or sleeve 260 which is also rectangular in cross-section rather than cylindrical and which provides further shielding of coil 210 similar to the function of sleeves 60 and 60' in the embodiment of FIGS. 5 and 6. A connector 46 makes electrical contact with one end 212 of coil 210 which is received in a cutaway portion 214 of conductive shell or sleeve 260.

As in the previously described embodiments, the threads on rectangular deflection structure 202 may either be male threads 222 formed on a central conductive bar or sleeve 220 which is rectangular in cross-section, as shown in FIG. 11, or the threads may be female threads formed on the inner surface of a rectangular sleeve which may be split to facilitate mounting of the rectangular helical deflection coil therein. Similarly, the rectangular helical deflection coil may be constructed using either a circular core conductor or a rectangular core conductor similar to that utilized in FIG. 4.

Figure 12:
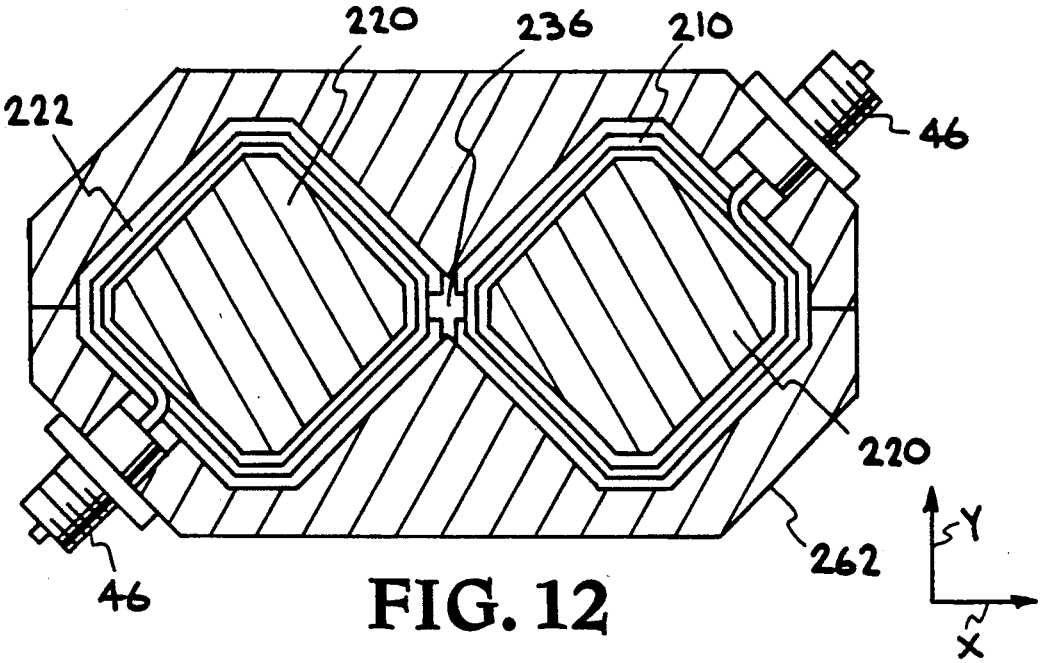
FIG. 12 is a cross-sectional end view of another embodiment wherein two of the previously described deflection structures ar mounted together to deflect the beam in both positive and negative directions along one plane.

FIG. 12 shows another embodiment of the invention wherein two deflection coil structures 202, constructed similar to the structure of FIG. 11, have been mounted side by side in a common housing 262, with the electron beam passageways formed in each structure contiguous to one another along the entire beam path, i.e., to form a common electron beam passageway 236 so that both deflection structures act on the beam in combination, e.g., to influence the beam in both directions in the x plane using appropriate circuitry to applied signals of opposite sign to the respective deflection coil structures, as is well known in the CRT art. In such a dual deflection coil structure, it will be understood that any and all of the previously described modifications may be utilized in the construction of either of the deflection coil structures used together, although it will be appreciated that the use of two identically formed deflection coils together may have significant performance advantages.

Figure 13:
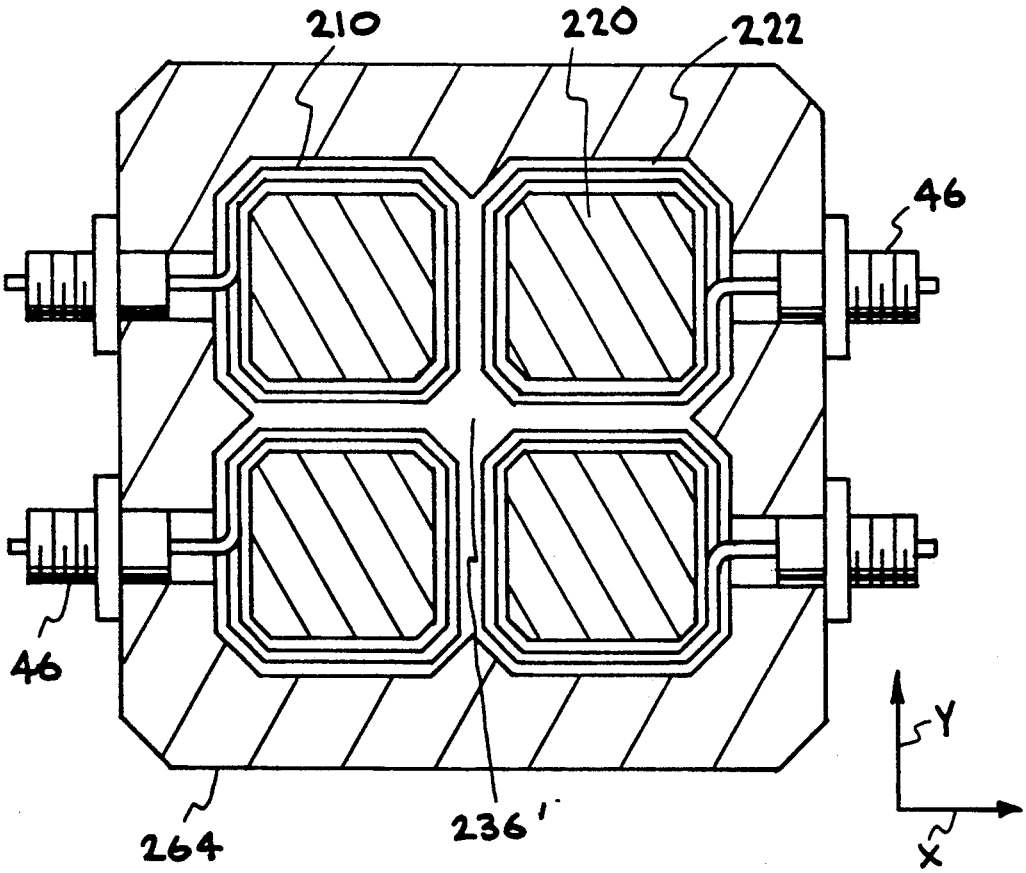
FIG. 13 is a cross-sectional end view of another embodiment wherein four of the previously described deflection structures are mounted together to deflect the beam in both positive and negative directions along both the x and y planes.

The electron beam may be deflected in both the x and y planes, as shown in FIG. 13, by using four such deflection structures having a common beam passageway 236' shared or formed by four deflection coil structures 202 by notched threads or slots formed in each structure, as previously described in the embodiment of FIG. 11. Deflection of the electron beam in both the x and y planes is accomplished by providing appropriate electrical signals to the four deflection coil structures 202, using any of the previously described modifications to the deflection coil structures with the four deflection coil structures 202 housed in a common housing 264. In both FIGS. 12 and 13, connectors 46 are shown which makes electrical contact with one end 212 of each coil 210. Each end 212 is received in a cutaway portion 214 of conductive shell 262, as shown in FIG. 12, or in a cutaway portion 214 of conductive shell 264, as shown in FIG. 13.

Thus, the invention provides an improved deflection coil structure for a CRT wherein adjacent turns of a helical coil used as a deflecting electrode for an electron beam are shielded from one another to prevent coupling of the signal from one turn of the coil to the next to thereby eliminate the generation of spurious fields wherein the beam is deflected out of synchronization with the pulse which cause erroneous signals to be displayed by the CRT.

The features of this invention allow use of this structure in ultra-high vacuum/high temperature environments where cathodes, such as used in CRTs, are adversely affected by organic or inorganic molecules emitted by high vapor pressure materials, such as insulators, during CRT preparative processing and use. Further, the embodiment of this invention in which no supports of the coil are necessary allows design of such structures to be free of additional capacitive coupling between the coil and the grounded shield of the threaded member, thus presenting no uncontrollable impediment to the transmission of high fidelity signals.

While specific embodiments of the deflection coil structure of the invention have been illustrated and described, in accordance with this invention, modifications and changes of the apparatus, parameters, materials, etc. will become apparent to those skilled in the art, and it is intended to cover in the appended claims all such modifications and changes which come within the scope of the invention.

What is claimed is:

1. A helical coil deflection structure for a cathode ray tube, to deflect an electron beam, comprising:

a. A conductor having a four-sided cross section of a given width and height, said conductor wound about an axis into a helical deflection coil having a plurality of equally spaced apart turns of a given pitch that extends along said axis, each turn having an outer diameter and an inner diameter which is smaller than said outer diameter;

b. A threaded electrically conductive member disposed about said axis and having a plurality of equalled spaced threads, each thread with a crown and sidewalls, and a root between adjacent threads, in which the sidewalls in adjacent threads and the root between said adjacent threads together surround three sides of each turn of said helical deflection coil disposed therein to shield each said turn from adjacent turns in said coil;

wherein said helical deflection coil and said threaded conductive member are both coaxially aligned about said axis in said structure, wherein said threaded conductive member comprises threads having a pitch which is the same as the pitch of said helical deflection coil; and wherein said threaded conductive member further comprises a respective notch formed in each of said threads to define an electron beam passageway having an axis aligned parallel to said axis.

2. The helical coil deflection structure of claim 1 wherein a respective distance between adjacent threads in said threaded member is greater than the width of said conductor.

3. The helical coil deflection structure of claim 1 wherein a respective distance between the crown and root of each of said threads is greater than the height of said conductor.

4. The helical coil deflection structure of claim 1 wherein said helical deflection coil and said threads on said threaded conductive member are both rectangular in cross-section.

5. The helical deflection coil structure of claim 1 wherein said threaded electrically conductive member comprises male threads wherein a diameter defined by the crowns of said male threads is larger than the outer diameter of said deflection coil and wherein a diameter defined by the roots of said threaded member is smaller than the inside diameter of said deflection coil whereby said turns of said coil fit in between said threads and are shielded by said threads without contacting said threads.

6. The helical coil deflection structure of claim 1 wherein a fourth side of each turn in said coil, adjacent to a line between the crowns of adjacent threads is also shielded by an electrically conductive sleeve which contacts the threads on said threaded member.

7. The helical coil deflection structure of claim 1 wherein a fourth side of each turn in said coil, adjacent to a line between the crowns of adjacent threads, is also shielded by an electrically conductive sleeve coaxially aligned about said axis with said threaded member, which contact the threads on said threaded member.

8. The helical coil structure of claim 1 wherein said conductor is rectangular in cross section.

9. The helical deflection coil structure of claim 1 wherein said threaded electrically conductive member comprises female threads wherein a diameter defined by the crowns of said female threads is smaller than the inner diameter of said deflection coil and wherein a diameter defined by the roots of said female threads is larger than the outer diameter of said deflection coil whereby said turns of said coil fit in between said threads and are shielded by said threads without contacting said threads.

10. The helical deflection coil structure of claim 9 wherein said threaded electrically conductive member comprises two generally identical halves to facilitate mounting said deflection coil of said female threads in said threaded electrically conductive member halves along an axial plane of said female threads.

11. A helical coil deflection structure for a cathode ray tube, to deflect an electron beam, comprising:

a. A conductor having a four-sided cross section of a given width and height, said conductor wound about a first axis into a first helical deflection coil having a plurality of equally spaced turns of a given pitch that extends along said first axis, each turn having an outer diameter and an inner diameter, which is smaller than said outer diameter;

b. A first threaded electrically conductive member disposed about said first axis and having a plurality of equalled spaced threads, each thread with a crown and sidewalls, and a root between adjacent threads, in which the sidewalls in adjacent threads and the root between said adjacent threads together surround three sides of each turn of said first helical deflection coil disposed therein to shield each said turn from adjacent turns in said first coil;

c. A conductor having a four sided cross section of a given width and height, said conductor wound about a second axis into a second helical deflection coil having a plurality of equally spaced turns of a given pitch that extends along said second axis, each turn having an outer diameter and an inner diameter, which is smaller than said outer diameter;

d. A second threaded electrically conductive member disposed about said second axis and having a plurality of equalled spaced threads, each thread with a crown and sidewalls, and a root between adjacent threads, in which the sidewalls in adjacent threads and the root between said adjacent threads together surround three sides of each turn of said second helical deflection coil disposed therein to shield each said turn from adjacent turns in said second coil;

wherein said first helical deflection coil and said first threaded conductive member are both coaxially aligned about said first axis in said structure, wherein said second helical deflection coil and said second threaded conductive member are both coaxially aligned about said second axis in said structure, wherein said first threaded conductive member comprises threads having a pitch which is the same as the pitch of said first helical deflection coil, wherein said first threaded conductive member comprises a respective notch formed in each of said threads to define a first electron beam passageway having an axis aligned parallel to said first axis, wherein said second threaded conductive member further comprises a respective notch formed in each of said threads to define a second electron beam passageway having an axis aligned parallel to said second axis, and wherein said first electron beam passageway is arranged contiguous to said second electron beam passageway to form a common electron beam passageway so as to deflect said electron beam along one plane perpendicular to said common electron beam passageway.

12. A helical coil deflection structure for a cathode ray tube comprising:

a. A conductor having a four-sided cross section of a given width and height, said conductor wound about an axis into a helical deflection coil having a fixed number of turns of a given pitch that extends along said axis between two ends of said coil;

b. A threaded conductive member coaxially aligned with said coil about said axis and electrically insulated from said coil and having:

i) At least one more thread than the number of turns of said coil;

ii) A thread pitch substantially the same as said coil pitch;

iii) A crown defined on each thread and a root defined between adjacent threads, said root having a length greater than the width of said conductor; whereby each turn of said coil is located within a respective space defined by said root length and a respective defined distance between said root and said thread crown to thereby electrically shield at least three sides of each of said turns of said coil from adjacent turns of said coil;

vi) A respective notch formed in each of said threads to define an electron beam passageway having an axis aligned parallel to said axis; and c. Means for making electrical connection to each end of said coil.

13. The helical coil deflection structure of claim 12 which further comprises an electrically conductive member which contacts said crowns of said threads on said threaded member, whereby a fourth side of each turn in said coil, adjacent to a line between the crowns of adjacent threads of said threaded member, is also shielded by said electrically conductive member.

14. The helical deflection structure of claim 12 wherein said threaded conductive member is electrically grounded.

15. The helical coil deflection structure of claim 12 wherein said threads of said threaded conductive member comprise male threads.

16. The helical coil deflection structure of claim 12 wherein said threads of said threaded conductive member comprise female threads.

17. A helical coil deflection structure for a cathode ray tube comprising:

a) A conductor having a circular cross section, said conductor wound about an axis into a helical deflection coil having a fixed number of turns of a given pitch, extending along said axis between two ends of said coil;

b) A threaded conductive member coaxially aligned with said coil about said axis, and electrically grounded and having:

i) At least one more thread than the number of turns of said coil;

ii) A thread pitch substantially the same as said coil pitch;

iii) A crown defined on each thread and a root defined between adjacent threads having a length greater than a respective diameter of said circular conductors;

iv) A respective notch formed in each of said threads to define an electron beam passageway having an axis aligned parallel to said axis;

whereby each turn of said coil is located within a respective spaced defined by said root length and a distance between said root and said thread crown to thereby electrically shield at least three equals portion of said circular cross section of each of said turns of said coil from adjacent turns to said coil;

c) An electrically conducting member which contacts said crowns of said threads on said threaded member, whereby a remaining fourth portion of said circular cross section of each turn in said coil, adjacent to a line between the crowns of adjacent threads of said threaded member, is also shielded by said electrically conductive member; and d) Means for making electrical connection to each end of said coil.

18. The helical coil deflection structure of claim 17 which further comprises means for providing mechanical support at each end of said helical coil and said threaded member wherein said helical coil is located in the spaces defined between adjacent threads of said threaded member and between the roots and crowns of said threaded member, each said space electrically separating said coil from said threaded member so as to prevent additional capacitive coupling between said coil and said electrically grounded threaded member and to prevent the emission of disruptive molecules when said structure is exposed to high temperature and high vacuum.

* * * * *